US009734761B2

(12) United States Patent
Kim et al.

(10) Patent No.: US 9,734,761 B2
(45) Date of Patent: Aug. 15, 2017

(54) PIXEL CIRCUIT, DRIVING METHOD FOR THE SAME, AND DISPLAY DEVICE

(71) Applicant: BOE TECHNOLOGY GROUP CO., LTD., Beijing (CN)

(72) Inventors: Tae Gyu Kim, Beijing (CN); Tuo Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/354,771

(22) PCT Filed: May 6, 2013

(86) PCT No.: PCT/CN2013/075176
§ 371 (c)(1),
(2) Date: Apr. 28, 2014

(87) PCT Pub. No.: WO2014/153806
PCT Pub. Date: Oct. 2, 2014

(65) Prior Publication Data

US 2015/0084842 A1 Mar. 26, 2015

(30) Foreign Application Priority Data

Mar. 29, 2013 (CN) ..... 2013 1 0108949

(51) Int. Cl.
*G09G 3/30* (2006.01)
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 2310/0264–2310/0297; G09G 3/30–3/3291; G09G 3/3258;
(Continued)

(56) References Cited

U.S. PATENT DOCUMENTS

2006/0208979 A1* 9/2006 Fish ..... G09G 3/3233 345/81
2006/0227083 A1* 10/2006 Miyazawa ..... 345/76
(Continued)

FOREIGN PATENT DOCUMENTS

CN 102789761 A 11/2012
CN 103000134 A 8/2013
CN 203134328 A 8/2013

OTHER PUBLICATIONS

Written Opinion of the International Searching Authority dated Dec. 26, 2013; PCT/CN2013/075176.
(Continued)

*Primary Examiner* — Matthew Sim
(74) *Attorney, Agent, or Firm* — Ladas & Parry LLP

(57) ABSTRACT

The present disclosure relates to the art of display manufacture. There are provided a pixel circuit, a driving method for the same and a display device. The pixel circuit comprises a light-emitting device and a driving transistor connected in series between a first voltage signal terminal and a second voltage signal terminal, and the pixel circuit further comprises a light-emitting control module and a compensation module; the light-emitting control module has an input terminal connected to a first control signal, an output terminal connected to the source and the drain of the driving transistor, and the light-emitting module is configured to control the state of the driving transistor in response to the first control signal so that the light-emitting device emits light or is turned off; the compensation module has an input terminal connected to a second control signal, and an output
(Continued)

terminal connected to the gate and the source of the driving transistor, and to the light-emitting control module, and the compensation module is configured to disconnect or connect the gate and the source of the driving transistor in response to the second control signal, so that the voltage at the gate of the driving transistor compensates for the threshold voltage of the driving transistor when the light-emitting device emits light. The issue of the poor uniformity of the light-emitting diode in luminance can be addressed by the above technical solutions.

14 Claims, 4 Drawing Sheets

(52) U.S. Cl.
CPC ..... *G09G 2300/0852* (2013.01); *G09G 2300/0861* (2013.01); *G09G 2320/0233* (2013.01); *G09G 2320/043* (2013.01)

(58) Field of Classification Search
CPC ..... G09G 3/3233; G09G 2300/0819; G09G 2300/0852; G09G 2320/0233; G09G 2320/043; G09G 2300/0861
See application file for complete search history.

(56) References Cited

U.S. PATENT DOCUMENTS

2012/0105387 A1* 5/2012 Choi ..... 345/204
2014/0175992 A1 6/2014 Yang

OTHER PUBLICATIONS

First Chinese Office Action Appln. No. 201310108949.9; Dated Aug. 29, 2014.
Second Chinese Office Action dated Nov. 17, 2014; Appln. No. 201310108949.9.

* cited by examiner

PIXEL CIRCUIT, DRIVING METHOD FOR THE SAME, AND DISPLAY DEVICE

TECHNICAL FIELD

The present disclosure relates to a field of the manufacture of displays, particularly to a pixel circuit and a driving method for the same, a display device.

BACKGROUND

An Active Matrix Organic Light Emitting Diode (AMOLED) display, as a new-style displaying technology, has many advantages in terms of view angle range, picture quality, efficiency, cost, and the like, as compared to a Field Effect Thin Film Transistor (TFT) Liquid Crystal Display (LCD), and thus has a great potential for development in the field of the manufacture of displays.

The AMOLED can emit light since it is driven by the currents generated by the driving TFTs in the saturation state, however, the uniformity of the currents is poor and thus the uniformity of the luminance is always poor since different driving currents may be generated by the different critical voltages even if the same gray level voltages are inputted.

The conventional 2T1C circuit as shown in FIG. 1 only comprises two TFTs, wherein T1 is a switch transistor and DTFT is a driving transistor for a pixel. A scan line Scan turns on the switch transistor T1, and a data voltage Data charges a storage capacitor C; the switch T1 is turned off during the period of light-emitting, and the voltage stored on the capacitor keeps the driving transistor DTFT turned on; the turning on current drives the OLED to emit light. In order to achieve a stable display, it is required that a stable current is supplied to the OLED. The voltage control circuit has advantages such as a simple structure, a fast speed for charging the capacitor, and the like, while the voltage control circuit has a disadvantage that it is difficult to perform a linear control on the driving current, since the uniformity in threshold voltage $V_{th}$ of DTFT is very poor due to the low temperature poly-silicon manufacturing process, and at the same time the threshold voltage $V_{th}$ also drifts; even if same technical parameters are used in the manufacture of the TFTs, there are large variations in the threshold voltages $V_{th}$ of the different TFTs, thus giving rise to the issues of poor uniformity in the light-emitting luminance and luminance attenuation in the driving circuit for light-emitting.

SUMMARY

In view of the above, the embodiments of the present disclosure are intended to provide a pixel circuit, a driving method for the same, and a display device, for compensating for the uniformity of the threshold voltage $V_{th}$ for the driving transistor in the pixel circuit and addressing the issue of the poor uniformity in the light-emitting luminance of the light-emitting diode.

According to one aspect of the present disclosure, there is provided a pixel circuit, and the pixel circuit comprises a light-emitting device and a driving transistor for driving the light-emitting device connected in series between a first voltage signal terminal and a second voltage signal terminal, and the pixel circuit further comprises a light-emitting control module and a compensation module, wherein the light-emitting control module has an input terminal connected to a first control signal, an output terminal connected to the source and the drain of the driving transistor, and is configured to control the state of the driving transistor in response to the first control signal to make the light-emitting device emit light or turn off the light-emitting device;

the compensation module has an input terminal connected to a second control signal, and an output terminal connected to the gate and the source of the driving transistor, and to the light-emitting control module, and the compensation module is configured to disconnect or connect the gate and the source of the driving transistor in response to the second control signal, so that the voltage at the gate of the driving transistor compensates for the threshold voltage of the driving transistor when the light-emitting device emits light.

Optionally, the light-emitting control module comprises:

a second switch transistor whose gate is connected to the first control signal, and source is connected to the drain of the driving transistor;

a third switch transistor whose gate is connected to the first control signal to disconnect or connect the driving transistor and the light-emitting device in response to the first control signal, drain is connected to the source of the driving transistor, and source is connected to the light-emitting device;

the compensation module comprises:

a first capacitor and a second capacitor connected in series between the drain of the second switch transistor and the gate of the driving transistor;

a first switch transistor arranged between the gate and the source of the driving transistor, whose gate is connected to the second control signal, and which is used to disconnect or connect the gate and the source of the driving transistor in response to the second control signal.

Optionally, the compensation module further comprises:

a fifth switch transistor whose gate is connected to the second control signal, source is connected to a reference voltage, and drain is connected to a common connection terminal between the first capacitor and the second capacitor.

Optionally, the compensation module further comprises:

a fourth switch transistor arranged between a data signal terminal and a common connection terminal of the second switch transistor and the first capacitor, wherein the fourth switch transistor has the gate connected to the second control signal, the drain connected to one terminal of the first capacitor, and the source connected to a data signal.

Optionally, the reference voltage is a grounding voltage.

Optionally, in the above pixel circuit, in a first phase, the first control signal and the second control signal are at a low level, so that the first, second and third switch transistors are turned on, and the gate of the driving transistor is connected to the drain of the driving transistor;

in a second phase, the first control signal is at a high level, the second control signal is at a low level, so that the first switch transistor is turned on, the second and third switch transistors are turned off, and the gate of the driving transistor is maintained to be connected to the drain of the driving transistor; and in a third phase, the first control signal is at a low level, the second control signal is at a high level, so that the first switch transistor is turned off, the second and third switch transistors are turned on, the gate of the driving transistor is disconnected from the drain of the driving transistor, the driving transistor is in a saturation state, and the light-emitting device emits light.

According to another aspect, a method for driving the pixel circuit as described above is provided, wherein the method comprises:

in a first phase, applying the first control signal and the second control signal, so that the light-emitting control module responds to the first control signal and the compensation module responds to the second control signal, and the gate of the driving transistor is connected to the drain of the driving transistor;

in a second phase, applying the first control signal and the second control signal, so that the light-emitting control module responds to the first control signal and the compensation module responds to the second control signal, and the gate of the driving transistor is maintained to be connected to the drain of the driving transistor; and in a third phase, applying the first control signal and the second control signal, so that the light-emitting control module responds to the first control signal and the compensation module responds to the second control signal, and the driving transistor is in a saturation state and the light-emitting device emits light.

Optionally, in the above method, the light-emitting control module particularly comprises:

a second switch transistor whose gate is connected to the first control signal, and source is connected to the drain of the driving transistor;

a third switch transistor whose gate is connected to the first control signal to disconnect or connect the driving transistor and the light-emitting device in response to the first control signal, drain is connected to the source of the driving transistor, and source is connected to the light-emitting device;

the compensation module comprises:

a first capacitor and a second capacitor connected in series between the drain of the second switch transistor and the gate of the driving transistor;

a first switch transistor arranged between the gate and the source of the driving transistor, wherein the first switch transistor has the gate connected to the second control signal, and which is used to disconnect or connect the gate and the source of the driving transistor in response to the second control signal;

a fifth switch transistor whose gate is connected to the second control signal, source is connected to a reference voltage, and drain is connected to a common connection terminal between the first capacitor and the second capacitor; and a fourth switch transistor arranged between a data signal terminal and a common connection terminal of the second switch transistor and the first capacitor, wherein the fourth switch transistor has the gate connected to the second control signal, the drain connected to one terminal of the first capacitor, and the source connected to a data signal;

wherein, in the first phase, the first, second, third, fourth and fifth switch transistors are all turned on;

in the second phase, the first, fourth and fifth switch transistor are turned on, and the second switch transistor and the third switch transistor are turned off; and in the third phase, the first, fourth and fifth switch transistor are turned off, and the second switch transistor and the third switch transistor are turned on.

Optionally, in the above method, in the first phase, the first control signal and the second control signal are at a low level, and the data signal is at a low level; in the second phase, the first control signal is at a high level, and the second control signal is at a low level, and the data signal is at a high level; in the third phase, the first control signal is at a low level, the second control signal is at a high level, and the data signal is at a low level.

According to one aspect of the disclosures, there is provided a display device comprising any of the pixel circuits as described above.

At least one of the technical solutions according to the illustrative embodiments of the present disclosure has the following beneficial effects:

in the above pixel circuit, the driving transistor for driving the light-emitting device to emit light is controlled to be in different states during different phases by the controlling of the first control signal and the second control signal as inputted, so that the threshold voltage $V_{th}$ of the driving transistor can be reflected by the voltage at the point A, i.e., the potential at the gate of the driving transistor, and the threshold voltage $V_{th}$ of the driving transistor can be compensated for by the second capacitor C2 when the light-emitting device emits light, so as to ensure the uniformity of the light-emitting luminance of the light-emitting device.

DETAILED DESCRIPTION OF THE PREFERRED EMBODIMENTS

To make the object, technical solution and advantageous of the present disclosure more clear, hereinafter, detailed descriptions will be made to the embodiments of the present disclosure in connection with the appended drawings.

Figure 7:
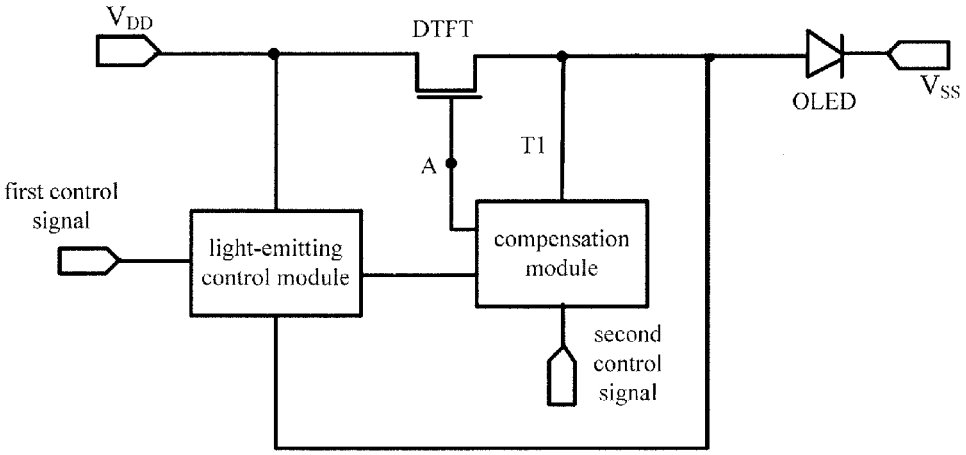
FIG. 7 is a schematic diagram for illustrating the principle of the pixel circuit according to the exemplary embodiments of the present disclosure.

As shown in FIG. 7, the pixel circuit according to an exemplary embodiment of the present disclosure comprises a light-emitting device OLED and a driving transistor DTFT for driving the light-emitting device OLED connected in series between a first voltage signal terminal $V_{DD}$ and a second voltage signal terminal $V_{SS}$, and the pixel circuit further comprises a light-emitting control module and a compensation module.

An input terminal of the light-emitting control module is configured to receive a first control signal, an output terminal of the light-emitting control module is connected to the source and the drain of the driving transistor DTFT, and the light-emitting module is configured to control the state of the driving transistor DTFT in response to the first control signal so that the light-emitting device OLED emits light or is turned off An input terminal of the compensation module is configured to receive a second control signal, and an output terminal of the compensation module is connected to the gate and the source of the driving transistor DTFT, and to the light-emitting control module, and the compensation module is configured to disconnect or connect the gate and the source of the driving transistor DTFT in response to the second control signal, so that the voltage at the gate of the driving transistor DTFT compensates for the threshold voltage of the driving transistor DTFT when the light-emitting device OLED emits light.

In an exemplary embodiment, the light-emitting control module may comprise:

a second switch transistor whose gate is connected to the first control signal, and source is connected to the drain of the driving transistor DTFT;

a third switch transistor whose gate is connected to the first control signal to disconnect or connect the driving transistor DTFT and the light-emitting device OLED in response to the first control signal, drain is connected to the source of the driving transistor DTFT, and source is connected to the light-emitting device OLED.

In an exemplary embodiment of the present disclosure, the compensation module may comprise:

a first capacitor and a second capacitor connected in series between the drain of the second switch transistor and the gate of the driving transistor DTFT;

a first switch transistor arranged between the gate and the source of the driving transistor DTFT, whose gate is connected to the second control signal, and which is used to disconnect or connect the gate and the source of the driving transistor DTFT in response to the second control signal;

a fifth switch transistor whose gate is connected to the second control signal, source is connected to a reference voltage, and drain is connected to a common connection terminal between the first capacitor and the second capacitor; and a fourth switch transistor arranged between a data signal terminal and a common connection terminal of the second switch transistor and the first capacitor, whose gate is connected to the second control signal, drain is connected to one terminal of the first capacitor, and source is connected to a data signal.

In a pixel circuit according to the exemplary embodiment of the disclosure, the second switch transistor, the first capacitor and the second capacitor are connected in series sequentially between the first voltage signal terminal and the gate of the driving transistor DTFT, wherein the gate of the second switch transistor is connected to the first control signal, which is used to disconnect or connect the gate and the drain of the driving transistor DTFT in response to the first control signal;

the third switch transistor is arranged between the second voltage signal terminal and the source of the driving transistor DTFT, wherein the gate of the third switch transistor is connected to the first control signal, which is used to disconnect or connect the driving transistor DTFT and the light-emitting element OLED in response to the first control signal; and the first switch transistor is arranged between the gate and the source of the driving transistor DTFT, wherein the gate of the first switch transistor is connected to the second control signal, which is used to disconnect or connect the gate and the source of the driving transistor DTFT in response to the second control signal.

In the pixel circuit, the driving transistor DTFT for driving the light-emitting device OLED to emit light is controlled to be in different states in different phases by the controlling of the first control signal and the second control signal as inputted, so that the threshold voltage $V_{th}$ of the driving transistor DTFT can be reflected by the voltage at the point A, i.e., the voltage at the gate of the driving transistor DTFT, and the threshold voltage $V_{th}$ of the driving transistor can be compensated for by the second capacitor C2 when the light-emitting device OLED emits light, so as to ensure the uniformity of the light-emitting luminance of the light-emitting device.

Optionally, the reference voltage is a grounding voltage.

Further, the light-emitting device OLED is connected between the second voltage signal terminal and the third switch transistor.

Hereinafter detailed descriptions will be given to a specific structure of a pixel circuit according to an embodiment of the disclosure.

Figure 1:
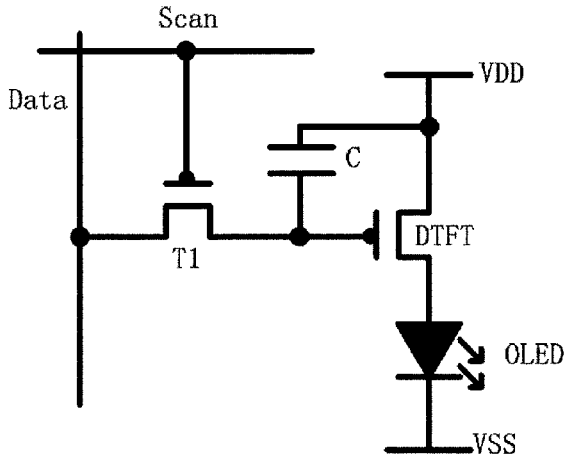
FIG. 1 is a schematic diagram illustrating a connection structure of a pixel circuit in the prior art.
Figure 2:
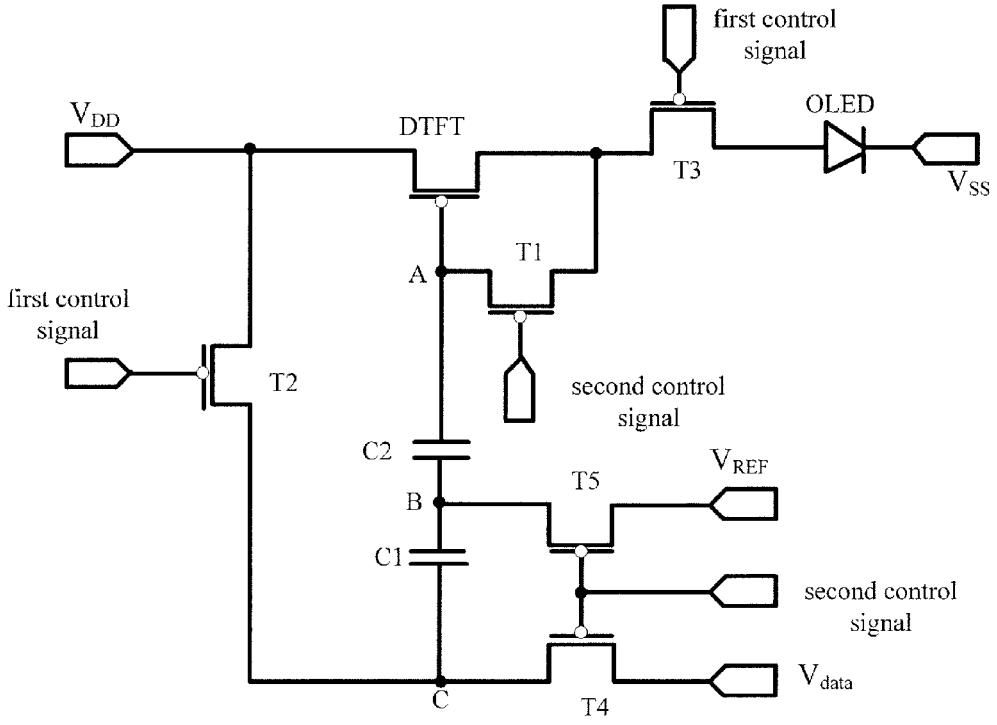
FIG. 2 is a schematic diagram illustrating a configuration of a pixel circuit according to an exemplary embodiment of the present disclosure.

FIG. 2 shows a schematic structure diagram of a pixel circuit according to an illustrative embodiment of the disclosure. With reference to FIG. 2, the structure of the pixel circuit according to the embodiment of the present disclosure comprises six Thin Film Transistors (TFTs) and two capacitors C1 and C2, wherein the six TFTs are P-channel transistors, and T1~T5 are switch transistors, and DTFT is a driving transistor. In the following description, for the transistors T1~T5 and the driving transistor, the source and the drain are defined in terms of the following direction of a reference current, an electrode into which the reference current flows serves as the source, and an electrode from which the reference current flows serves as the drain. In addition, two control signals, i.e., the first control signal and the second control signal, one data signal Vdata, three voltage signals VDD, VSS, and VREF are used in the present embodiment.

As shown in FIG. 2, the light-emitting device OLED and the driving transistor DTFT for driving the light-emitting device OLED are connected in series between the first voltage signal terminal VDD and the second voltage signal terminal VSS. The switch transistor T2, the capacitors C1 and C2 are connected in series sequentially between the first voltage signal terminal VDD and the gate of the driving transistor DTFT, the switch transistor T1 is connected between the gate and the drain of DTFT, the switch transistor T3 is connected between the OLED and the drain of the DTFT, the switch transistor T4 is connected between the common connection terminal of the switch transistor T2 and the capacitor C1 and the data voltage terminal Vdata, and the switch transistor T5 is connected between the common connection terminal of the capacitor C1 and the capacitor C2 and the reference voltage terminal VREF. Herein, the gates of the switch transistor T2 and the switch transistor T3 are used for receiving the first control signal, respectively, and the switch transistor T2 and the switch transistor T3 are turned off or turned on in response to the first control signal; the gates of the switch transistors T1, T4 and T5 are used for receiving the second control signal, respectively, and the switch transistors T1, T4 and T5 are turned off or turned on in response to the second control signal. In an illustrative embodiment of the disclosure, the gate of the switch transistor T4 and the gate of the switch transistor T5 are connected together, and at the same time connected to the second control signal.

Figure 3:
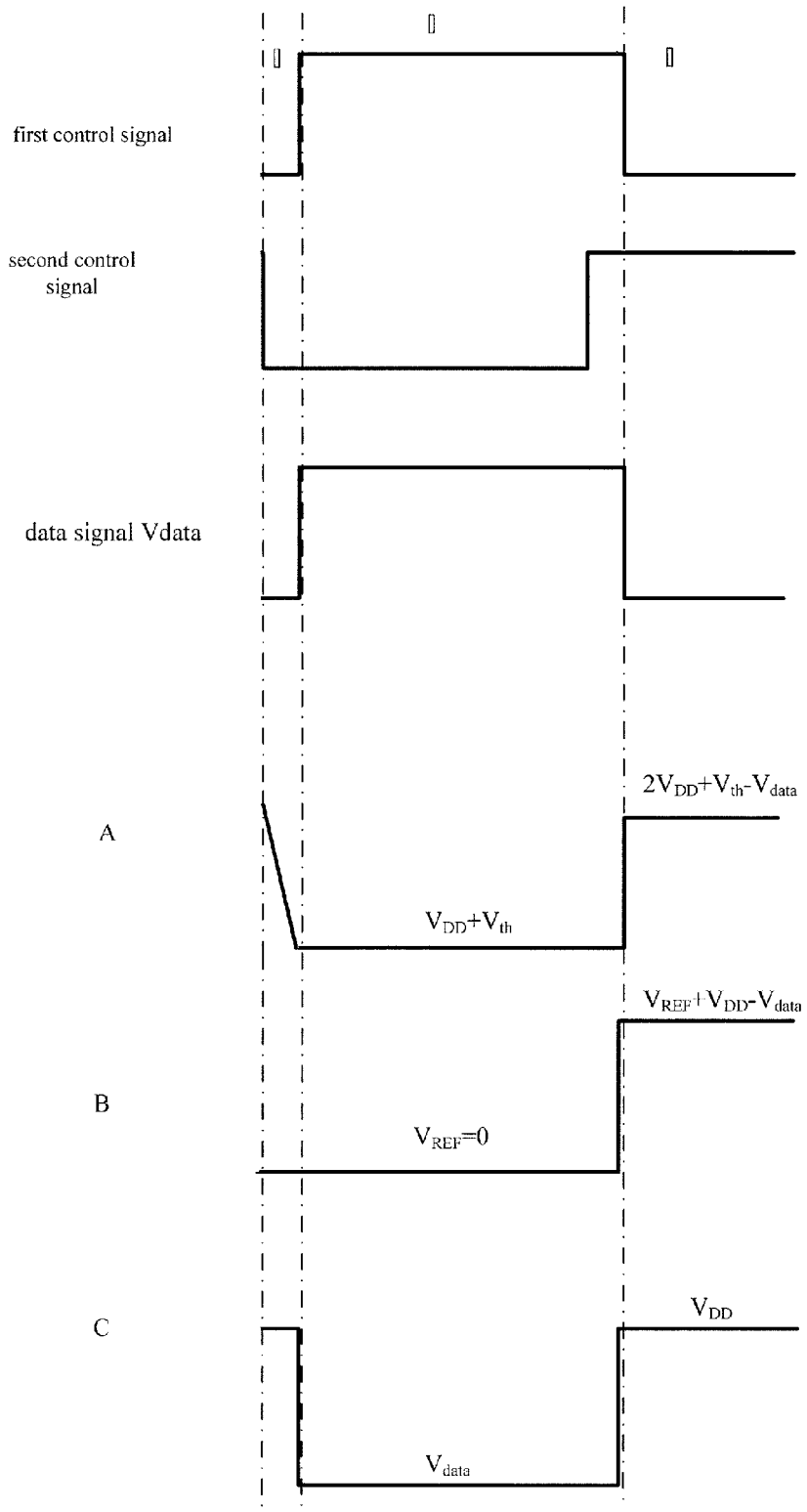
FIG. 3 is a timing diagram of the pixel circuit according to the exemplary embodiment of the present disclosure.

Next, detailed descriptions are given to the operation flow of the pixel circuit shown in FIG. 2 in connection with the timing diagram shown in FIG. 3.

1) A pixel resetting phase: the phase ① shown in the timing diagram represents the pixel resetting phase. In the phase, the first control signal is at a low level, and the second control signal is at a low level, and the data signal $V_{data}$ is at a low level.

Figure 4:
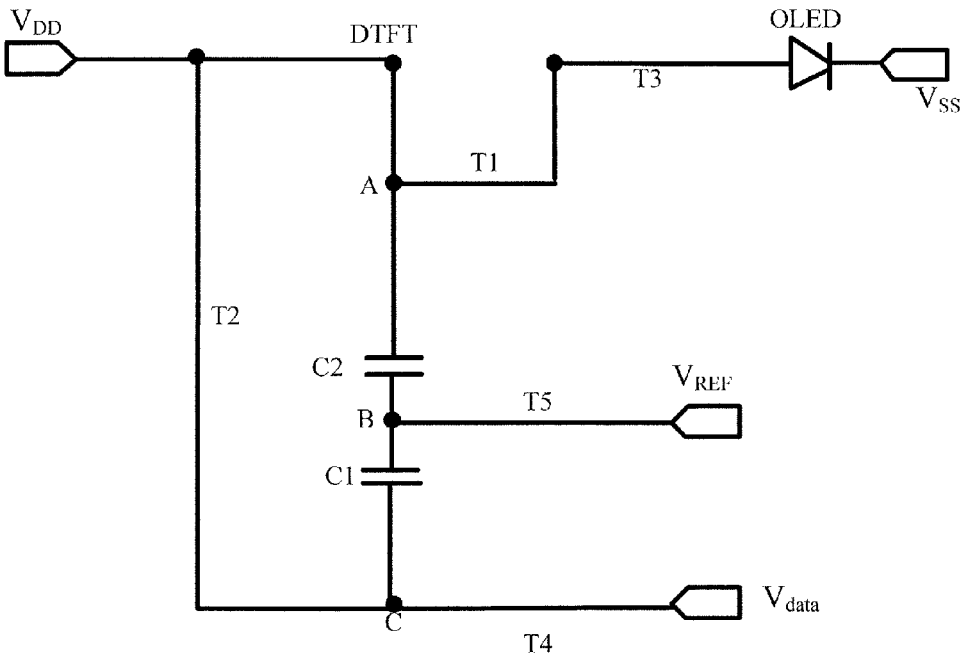
FIG. 4 is an equivalent circuit diagram of the pixel circuit according to the exemplary embodiment of the present disclosure in a first phase t1.

Referring to an equivalent circuit at this time in the phase ① as shown in FIG. 4, the switch transistors T1~T5 are all turned on. At this time, since the switch transistor T1 is turned on, the DTFT is in a state of diode connection. Here, the voltage at the drain of the DTFT is $V_{DD}+V_{th}$. At the end of the phase ①, the potential at the point A reaches $V_{DD}+V_{th}$, the potential at the point B is $V_{REF}$, and the potential at the point C is $V_{DD}$. In an illustrative embodiment of the disclosure, the reference voltage terminal $V_{REF}$ is grounded, and thus $V_{REF}$ is zero.

2) a data writing phase: the phase ② shown in the timing diagram represents the data writing phase. At this time, the first control signal is at a high level, and the second control signal is at a low level, and the data signal $V_{data}$ is at a high level.

Figure 5:
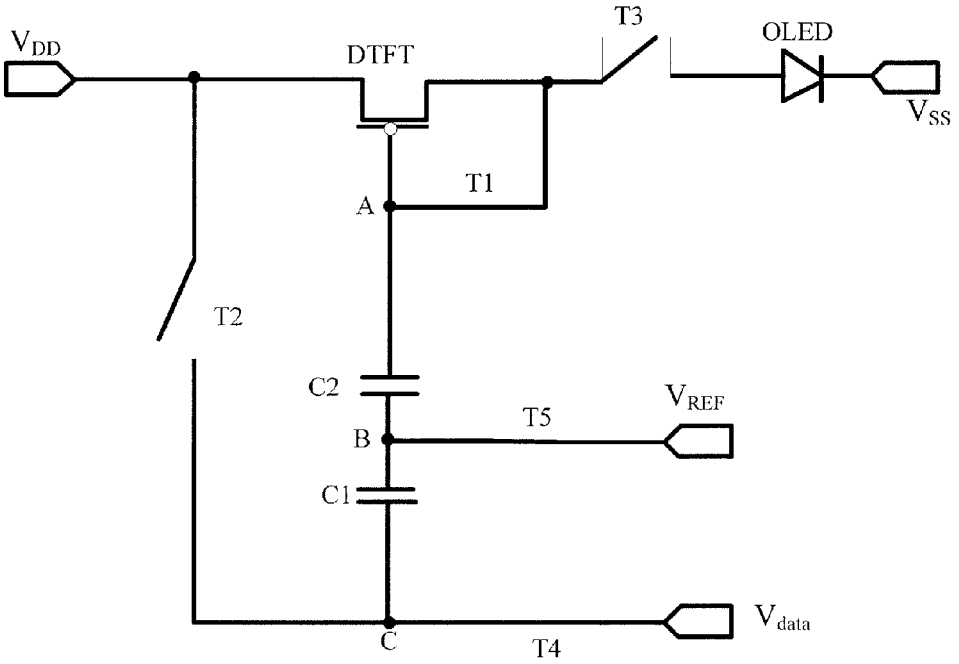
FIG. 5 is an equivalent circuit diagram of the pixel circuit according to the exemplary embodiment of the present disclosure in a first phase t2.

Referring to an equivalent circuit at this time in the phase ② as shown in FIG. 5, the switch transistors T1, T4 and T5 are turned on, and the switch transistors T2 and T3 are turned off. Since the switch transistor T1 connected between the gate and the source of the DTFT is turned on, the DTFT is maintained to be the state of diode connection, and the potential at the point A is kept unchanged; since the switch transistor T5 is turned on, the potential $V_{REF}$ at the common connection terminal B of the capacitors C1 and C2 is zero; since the switch transistor T2 is turned off and the switch transistor T4 is turned on, the potential at the common connection terminal C of the switch transistor T2 and the capacitor C1 is $V_{data}$, and the capacitors C1 and C2 are both in a charging state.

3) a light emitting phase: the phase ③ shown in the timing diagram represent the light emitting phase. At this time, the first control signal is at a low level, and the second control signal is at a high level, and the data signal $V_{data}$ is at a low level.

Figure 6:
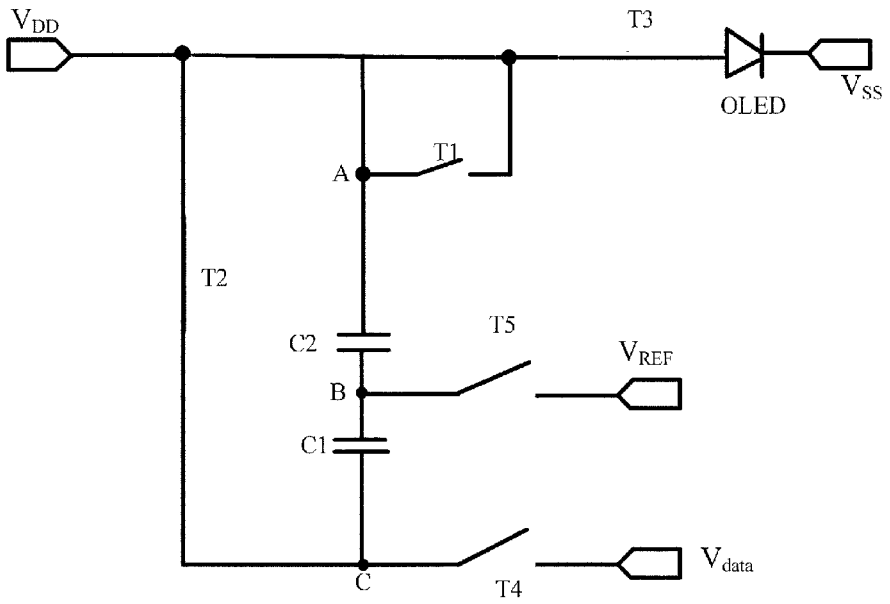
FIG. 6 is an equivalent circuit diagram of the pixel circuit according to the exemplary embodiment of the present disclosure in a third phase t3.

Referring to an equivalent circuit diagram of the phase ③ as shown in FIG. 6, at this time, the switch transistors T1, T4 and T5 are turned off, and the switch transistors T2 and T3 are turned on. Since the switch transistor T2 is turned on, the potential at the common connection terminal C of the switch transistor T2 and the capacitor C1 is changed to $V_{DD}$. Since the switch transistor T5 is turned off, the first capacitor C1 and the second capacitor C2 share an electrode, the potential at the point B is increased to $V_{REF}+V_{DD}-V_{data}$, and at the same time, the potential at the point A is increased to $2V_{DD}+V_{th}-V_{data}$. At this time, the voltage difference between the gate and the source for the DTFT, $V_{gs}=V_{DD}+V_{th}-V_{data}$. the DTFT is in a saturation state to charge the light-emitting device OLED, and the current outputted from the DTFT is as follows:

$$I = \frac{1}{2}\beta(V_{gs} - V_{th})^2 = \frac{1}{2}\beta(V_{DD} + V_{th} - V_{DATA} - V_{th})^2 = \frac{1}{2}\beta(V_{DD} - V_{DATA})^2$$

Therefore, the current flowing through the light-emitting device OLED is independent of the threshold voltage $V_{th}$ of the DTFT, and the current for driving the OLED can remain stable thereby improving the uniformity of the luminance of the panel.

In the pixel circuit according to the illustrative embodiments of the disclosure, the information on the threshold voltage $V_{th}$ of the driving transistor is fed back as the potential at the point A, i.e., the potential at the gate of the DTFT, and the variation of the threshold $V_{th}$ of the DTFT is compensated for by using a storage mode of capacitor C2, so that the driving current I of the driving transistor is independent of the threshold voltage $V_{th}$ to achieve the purpose of stabilizing the driving current and improving the uniformity of the luminance of the panel.

According to another aspect of the disclosure, there is provided a method for driving the pixel circuit as described above, wherein the method comprises:

in a first phase, applying a first control signal and a second control signal, so that the light-emitting control module responds to the first control signal and the compensation module responds to the second control signal, and the gate and the drain of the driving transistor DTFT are connected;

in a second phase, applying the first control signal and the second control signal, so that the light-emitting control module responds to the first control signal and the compensation module responds to the second control signal, and the gate and the drain of the driving transistor DTFT are maintained to be connected; and in a third phase, applying the first control signal and the second control signal, so that the light-emitting control module responds to the first control signal and the compensation module responds to the second control signal, and the driving transistor DTFT is in a saturation state and the light-emitting device OLED emits light.

The light-emitting control module may comprise:

a second switch transistor whose gate is connected to the first control signal, source is connected to the drain of the driving transistor DTFT;

a third switch transistor whose gate is connected to the first control signal to disconnect or connect the driving transistor DTFT and the light-emitting device OLED in response to the first control signal, drain is connected to the source of the driving transistor DTFT, and source is connected to the light-emitting device OLED.

The compensation module may comprise:

a first capacitor and a second capacitor connected in series between the drain of the second switch transistor and the gate of the driving transistor DTFT;

a first switch transistor arranged between the gate and the source of the driving transistor DTFT, whose gate is connected to the second control signal, and which is used to disconnect or connect the gate and the source of the driving transistor DTFT in response to the second control signal;

a fifth switch transistor whose gate is connected to the second control signal, source is connected to a reference voltage, and drain is connected to a common connection terminal between the first capacitor and the second capacitor; and a fourth switch transistor arranged between a data signal terminal and a common connection terminal of the second switch transistor and the first capacitor, whose gate is connected to the second control signal, drain is connected to one terminal of the first capacitor, and source connected to a data signal.

In an illustrative embodiment, in the first phase, the first, second, third, fourth and fifth switch transistors are all turned on;

in the second phase, the first switch transistor, fourth switch transistor and fifth switch transistor are turned on, and the second switch transistor and the third switch transistor are turned off; and in the third phase, the first, fourth and fifth switch transistor are turned off, and the second switch transistor and the third switch transistor are turned on.

Optionally, in the first phase, the first control signal and the second control signal are at a low level, and the data signal is at a low level; in the second phase, the first control signal is at a high level, and the second control signal is at a low level, and the data signal is at a high level; in the third phase, the first control signal is at a low level, the second control signal is at a high level, and the data signal is at a low level.

In the above method, the driving transistor for driving the light-emitting device to emit light is controlled to be in different states in different phases by the controlling of the first control signal and the second control signal as inputted, so that the threshold voltage $V_{th}$ of the driving transistor can be reflected by the voltage at the point A, i.e., the potential at the gate of the driving transistor, and the threshold voltage $V_{th}$ of the driving transistor can be compensated for by the second capacitor C2 when the light-emitting device emits light, so as to ensure the uniformity of the light-emitting luminance of the light-emitting device.

The above descriptions are only exemplary embodiments of the present disclosure, and in no way limit the scope of the present disclosure. It should be noted that those skilled in the art may make modifications and variations to the above embodiments without departing from the principle of the present disclosure. Such variations and modifications are intended to be included within the scope of the present disclosure.

What is claimed is:

1. A pixel circuit comprising a light-emitting device and a driving transistor for driving the light-emitting device connected in series between a first voltage signal terminal and a second voltage signal terminal, and the pixel circuit further comprising a light-emitting control module and a compensation module, wherein the light-emitting control module has an input terminal connected to a first control signal, a first output terminal directly electrically connected to a source of the driving transistor, and a second output terminal directly electrically connected to a drain of the driving transistor, and is configured to control a state of the driving transistor in response to the first control signal to make the light-emitting device emit light or turn off the light-emitting device;

the compensation module has an input terminal connected to a second control signal, and a first output terminal directly electrically connected to a gate of the driving transistor, a second output terminal directly electrically connected to a source of the driving transistor, and a third output terminal directly electrically connected to a third output terminal of the light-emitting control module, and the compensation module is configured to disconnect or connect the gate and the source of the driving transistor in response to the second control signal, so that a voltage at the gate of the driving transistor compensates for a threshold voltage of the driving transistor when the light-emitting device emits light, wherein the light-emitting control module comprises:

a second switch transistor whose gate is connected to the first control signal, and source is connected to the drain of the driving transistor;

a third switch transistor whose gate is connected to the first control signal to disconnect or connect the driving transistor and the light-emitting device in response to the first control signal, drain is connected to the source of the driving transistor, and source is connected to the light-emitting device;

the compensation module comprises:

a first capacitor and a second capacitor connected in series between the drain of the second switch transistor and the gate of the driving transistor, and one terminal of the first capacitor being directly electrically connected to the drain for the second switch transistor;

a first switch transistor arranged between the gate and the source of the driving transistor, whose gate is connected to the second control signal, and which is used to disconnect or connect the gate and the source of the driving transistor in response to the second control signal.

2. The pixel circuit of claim 1, wherein the compensation module further comprises:

a fifth switch transistor whose gate is connected to the second control signal, source is connected to a reference voltage, and drain is connected to a common connection terminal between the first capacitor and the second capacitor.

3. The pixel circuit of claim 2, wherein the compensation module further comprises:

a fourth switch transistor arranged between a data signal terminal and a common connection terminal of the second switch transistor and the first capacitor, whose gate is connected to the second control signal, drain is connected to one terminal of the first capacitor, and source is connected to a data signal.

4. The pixel circuit of claim 2, wherein the reference voltage is a grounding voltage.

5. The pixel circuit of claim 1, wherein in a first phase, the first control signal and the second control signal are at a low level, so that the first, second and third switch transistors are turned on, and the gate of the driving transistor is connected to the drain of the driving transistor;

in a second phase, the first control signal is at a high level, the second control signal is at a low level, so that the first switch transistor is turned on, the second and third switch transistors are turned off, and the gate of the driving transistor is maintained to be connected to the drain of the driving transistor; and in a third phase, the first control signal is at a low level, the second control signal is at a high level, so that the first switch transistor is turned off, the second and third switch transistors are turned on, the gate of the driving transistor is disconnected from the drain of the driving transistor, the driving transistor is in a saturation state, and the light-emitting device emits light.

6. A method for driving the pixel circuit of claim 1, comprising:

applying the first control signal and the second control signal, in a first phase, so that the light-emitting control module responds to the first control signal and the compensation module responds to the second control signal, and the gate of the driving transistor is connected to the drain of the driving transistor;

applying the first control signal and the second control signal, in a second phase, so that the light-emitting control module responds to the first control signal and the compensation module responds to the second control signal, and the gate of the driving transistor is maintained to be connected to the drain of the driving transistor; and applying the first control signal and the second control signal, in a third phase, so that the light-emitting control module responds to the first control signal and the compensation module responds to the second control signal, and the driving transistor is in a saturation state and the light-emitting device emits light.

7. The method of claim 6, wherein the light-emitting control module comprises:

a second switch transistor whose gate is connected to the first control signal, and source is connected to the drain of the driving transistor;

a third switch transistor whose gate is connected to the first control signal to disconnect or connect the driving transistor and the light-emitting device in response to the first control signal, drain is connected to the source of the driving transistor, and source is connected to the light-emitting device;

the compensation module comprises:

a first capacitor and a second capacitor connected in series between the drain of the second switch transistor and the gate of the driving transistor;

a first switch transistor arranged between the gate and the source of the driving transistor, whose gate is connected to the second control signal, and which is used to disconnect or connect the gate and the source of the driving transistor in response to the second control signal;

a fifth switch transistor whose gate is connected to the second control signal, source is connected to a reference voltage, and is drain connected to a common connection terminal between the first capacitor and the second capacitor; and a fourth switch transistor arranged between a data signal terminal and a common connection terminal of the second switch transistor and the first capacitor, whose gate is connected to the second control signal, drain is connected to one terminal of the first capacitor, and a source is connected to a data signal;

wherein the first, second, third, fourth and fifth switch transistors are all turned on in the first phase;

the first, fourth and fifth switch transistor are turned on, and the second switch transistor and the third switch transistor are turned off in the second phase; and the first, fourth and fifth switch transistor are turned off, and the second switch transistor and the third switch transistor are turned on in the third phase.

8. The method of claim 7, wherein in the first phase, the first control signal and the second control signal are at a low level, and the data signal is at a low level; in the second phase, the first control signal is at a high level, and the second control signal is at a low level, and the data signal is at a high level; and in the third phase, the first control signal is at a low level, the second control signal is at a high level, and the data signal is at a low level.

9. A display device comprising the pixel circuits of claim 1.

10. The display device of claim 9, wherein the light-emitting control module comprises:

a second switch transistor whose gate is connected to the first control signal, and source is connected to the drain of the driving transistor;

a third switch transistor whose gate is connected to the first control signal to disconnect or connect the driving transistor and the light-emitting device in response to the first control signal, drain is connected to the source of the driving transistor, and source is connected to the light-emitting device;

the compensation module comprises:

a first capacitor and a second capacitor connected in series between the drain of the second switch transistor and the gate of the driving transistor;

a first switch transistor arranged between the gate and the source of the driving transistor, whose gate is connected to the second control signal, and which is used to disconnect or connect the gate and the source of the driving transistor in response to the second control signal.

11. The display device of claim 10, wherein the compensation module further comprises:

a fifth switch transistor whose gate is connected to the second control signal, source is connected to a reference voltage, and drain is connected to a common connection terminal between the first capacitor and the second capacitor.

12. The display device of claim 11, wherein the compensation module further comprises:

a fourth switch transistor arranged between a data signal terminal and a common connection terminal of the second switch transistor and the first capacitor, whose gate is connected to the second control signal, drain is connected to one terminal of the first capacitor, and source is connected to a data signal.

13. The display device of claim 11, wherein the reference voltage is a grounding voltage.

14. The display device of claim 10, wherein in a first phase, the first control signal and the second control signal are at a low level, so that the first, second and third switch transistors are turned on, and the gate of the driving transistor is connected to the drain of the driving transistor;

in a second phase, the first control signal is at a high level, the second control signal is at a low level, so that the first switch transistor is turned on, the second and third switch transistors are turned off, and the gate of the driving transistor is maintained to be connected to the drain of the driving transistor; and in a third phase, the first control signal is at a low level, the second control signal is at a high level, so that the first switch transistor is turned off, the second and third switch transistors are turned on, the gate of the driving transistor is disconnected from the drain of the driving transistor, the driving transistor is in a saturation state, and the light-emitting device emits light.

* * * * *